US008240062B2

(12) United States Patent
Sukup

(10) Patent No.: US 8,240,062 B2
(45) Date of Patent: Aug. 14, 2012

(54) UNLOAD ROTOR ASSEMBLY FOR A GRAIN DRYER

(75) Inventor: Eugene G. Sukup, Hampton, IA (US)

(73) Assignee: Sukup Manufacturing Co., Sheffield, IA (US)

( * ) Notice: Subject to any disclaimer, the term of this patent is extended or adjusted under 35 U.S.C. 154(b) by 1019 days.

(21) Appl. No.: 11/307,136

(22) Filed: Jan. 25, 2006

(65) Prior Publication Data

US 2007/0169370 A1 Jul. 26, 2007

(51) Int. Cl.
*F26B 17/12* (2006.01)

(52) U.S. Cl. ..... 34/166; 34/173

(58) Field of Classification Search ..... 34/166, 34/173, 179; 432/131, 139; 414/306
See application file for complete search history.

(56) References Cited

U.S. PATENT DOCUMENTS

| | | | | |
|---|---|---|---|---|
| 1,251,692 | A * | 1/1918 | Pomeroy | 432/131 |
| 3,905,757 | A * | 9/1975 | von Dreusche, Jr. | 432/139 |
| 5,746,007 | A * | 5/1998 | Haleen | 34/166 |
| 6,073,364 | A | 6/2000 | McKenzie et al. | |

* cited by examiner

*Primary Examiner* — Jiping Lu
(74) *Attorney, Agent, or Firm* — Zarley Law Firm, P.L.C.

(57) ABSTRACT

A rotor assembly for a grain dryer having a framework and a number of wipers secured to the framework. The framework has a number of primary supports that extend radially outwardly from the central axis and a number of secondary support members connected to the end of the primary support members and positioned to engage the shelf floor of the grain bin.

1 Claim, 5 Drawing Sheets

UNLOAD ROTOR ASSEMBLY FOR A GRAIN DRYER

BACKGROUND OF THE INVENTION

This invention is directed to a grain dryer and more particularly to an unload rotor assembly for a grain dryer.

In order to store grain for a long period of time, it is necessary to dry the grain to a condition in which it is less subject to molding or other deterioration. Numerous types of grain dryers have been designed that utilize a rotor assembly to sweep grain deposited on a grain shelf floor toward a hopper for removing the grain from the drying column. With present rotor assemblies it is difficult to provide a uniform depth clearance between the floor and the wiper blades on the sweep arm especially at larger diameters. This may lead to wear on the floor and the wiper. Also, present rotor assemblies may catch on seams in the floor. Therefore, there is a need in the art for a rotor assembly that addresses these problems.

An object of the present invention is to provide a rotor assembly that operates more efficiently.

Another object of the present invention is to provide a rotor assembly that is less susceptible to wear.

A still further object of the present invention is to provide a rotor assembly that prevents overloading of the motor that powers the rotor.

These and other objectives will be apparent based on the following description.

SUMMARY OF THE INVENTION

A rotor assembly for a grain dryer having a framework and a number of wipers secured to the framework. The framework has a number of primary supports that extend radially outwardly from the central axis and a number of secondary support members connected to the end of the primary support members and positioned to engage the shelf floor of the grain bin.

DETAILED DESCRIPTION OF THE PREFERRED EMBODIMENT

Figure 1:
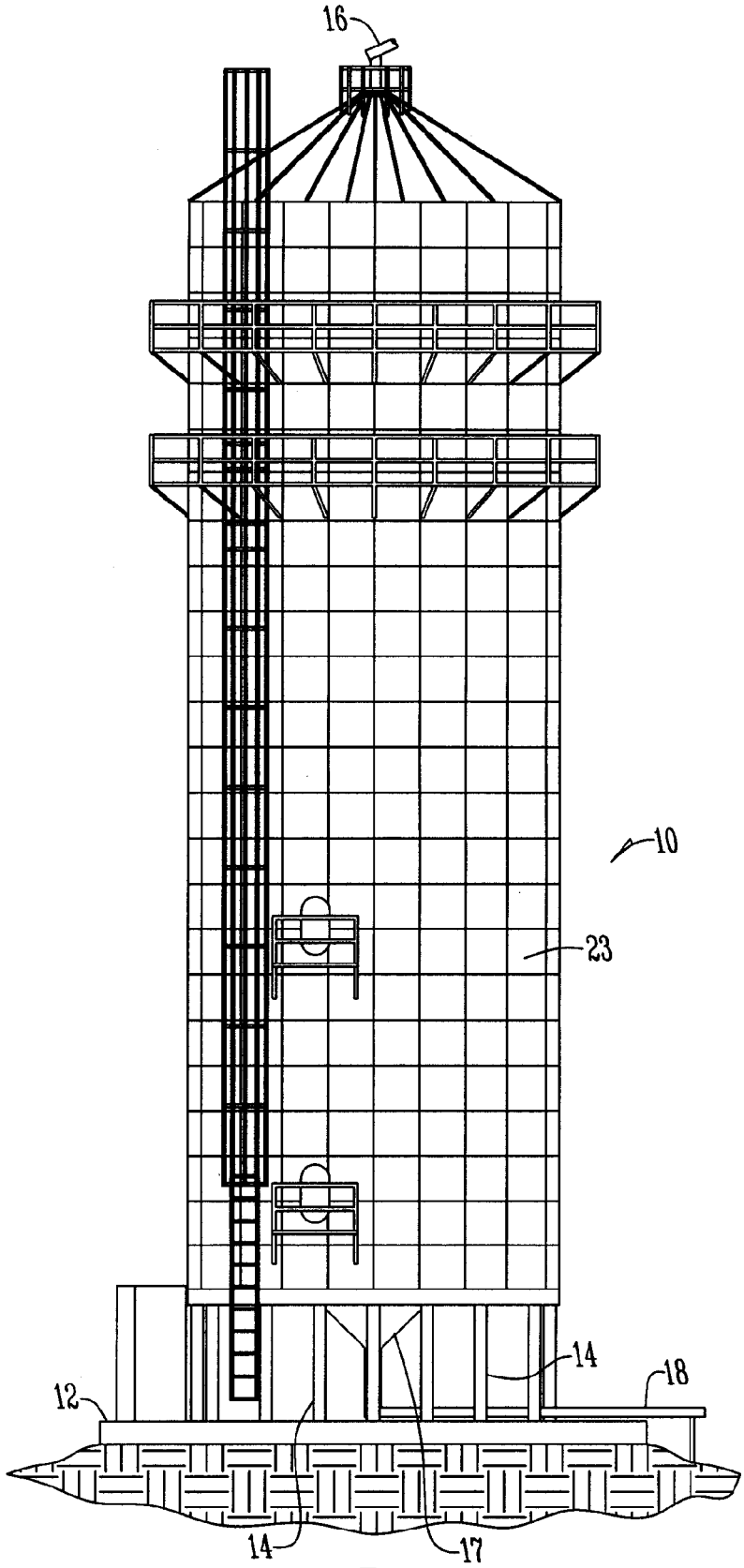
FIG. 1 is a side elevation view of a grain dryer.

Referring to the Figures, a grain dryer 10 is supported on a concrete pad 12. The grain dryer includes a number of legs 14 which extend onto the concrete pad 12. The grain dryer 10 further includes an inlet conduit 16, a hopper 17, and an outlet conduit 18. Grain is advanced into the grain dryer 10 through the inlet conduit 16. The grain advances through the grain dryer 10 where it is heated to reduce the moisture content. After the grain's moisture content is reduced and cooled, the grain is advanced via the unload rotor 28 into hopper 17 and out of the grain dryer through the outlet conduit 18, which allows for long term storage in a unit such as a grain bin.

The lower portion of the grain dryer 10 includes a grain shelf floor 20 and a floor of the cooling chamber 22 which define a sweep space 24 therebetween. The cooling chamber floor 22 is positioned vertically above the grain shelf floor 20. The grain shelf floor is circular in shape and is positioned in a substantially horizontal orientation. In addition, the cooling chamber floor 22 is positioned in a substantially parallel orientation in relation to the grain shelf floor 20. The grain shelf floor 20 is made from stainless steel and the cooling chamber floor 22 is made from galvanized sheet steel. A hopper opening 21 is defined in a center portion of the grain shelf floor 20.

The grain dryer 10 further includes an outer wall 23 and an inner wall 25 which collectively define a number of grain flow channels or paths 27 therebetween. A number of partitions define the lateral sides of the grain flow channels 27. Both the outer wall 23 and the inner wall 25 are perforated as is well known in the art in order to allow heated air to traverse the grain flow channels 27 and heat the grain flowing therein. The space defined by the grain flow channels 27 constitutes a drying space in which the grain traveling through this space is dried by heated air pushed from the inside to outside, (i.e. its moisture content is reduced). In the lower portion ambient air may be pushed from inside to outside to cool the grain.

A grain discharge slot 29 is defined between a lower end 31 of the inner wall 25 and the grain shelf floor 20. After dried grain reaches the lower end of the grain flow channels 27, it exits the grain discharge slot 29 and is advanced onto an outer peripheral portion of the grain floor shelf 20. Thereafter, a grain metering system 26 transports the grain from the outer peripheral portion of the grain shelf floor 20 to the hopper opening 21 defined in the center portion of the grain shelf floor 20.

Figure 2:
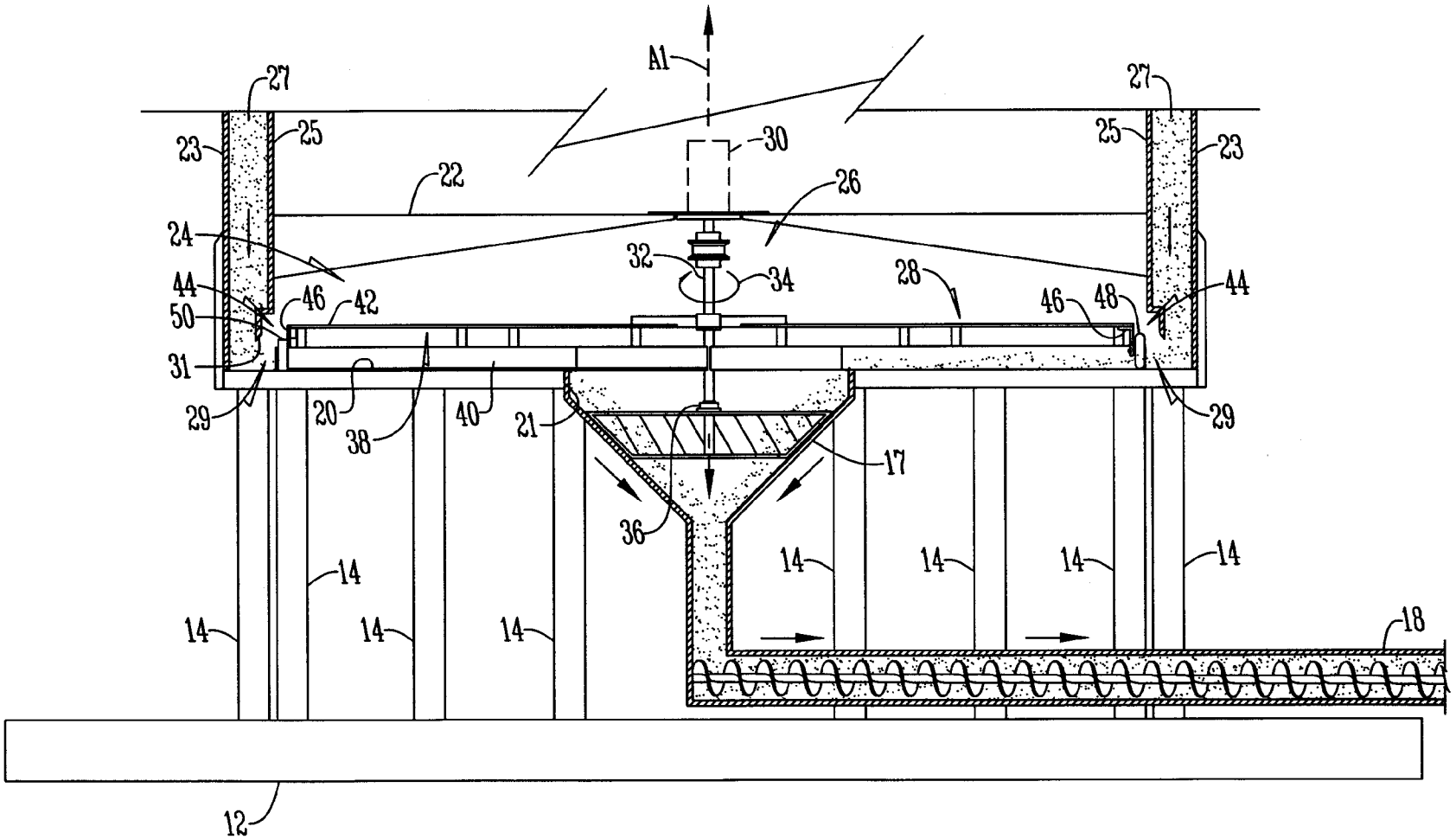
FIG. 2 is a cross sectional view of a lower portion of a grain dryer.
Figure 3:
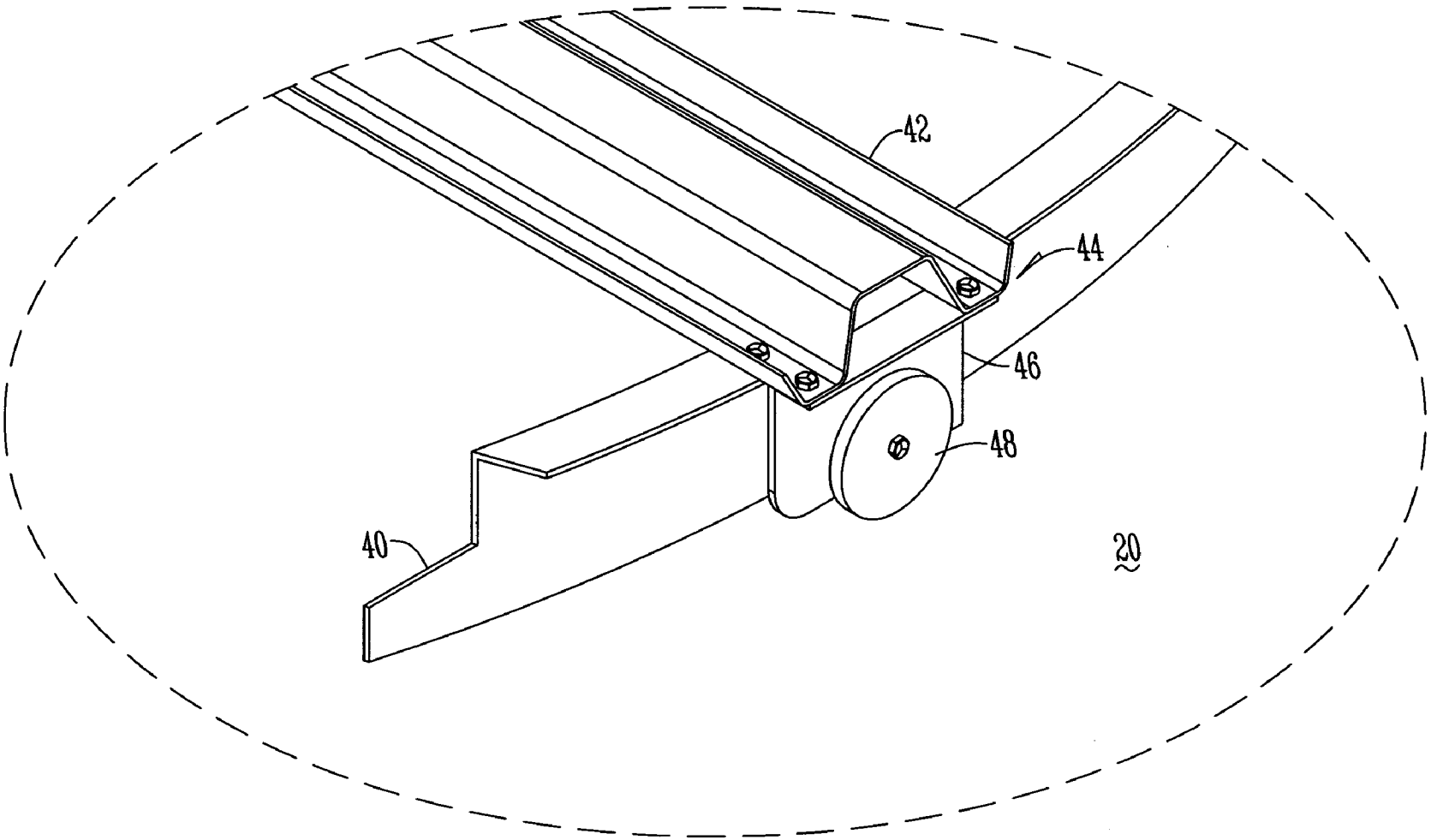
FIG. 3 is a perspective view of a portion of a rotor assembly for a grain dryer.
Figure 4:
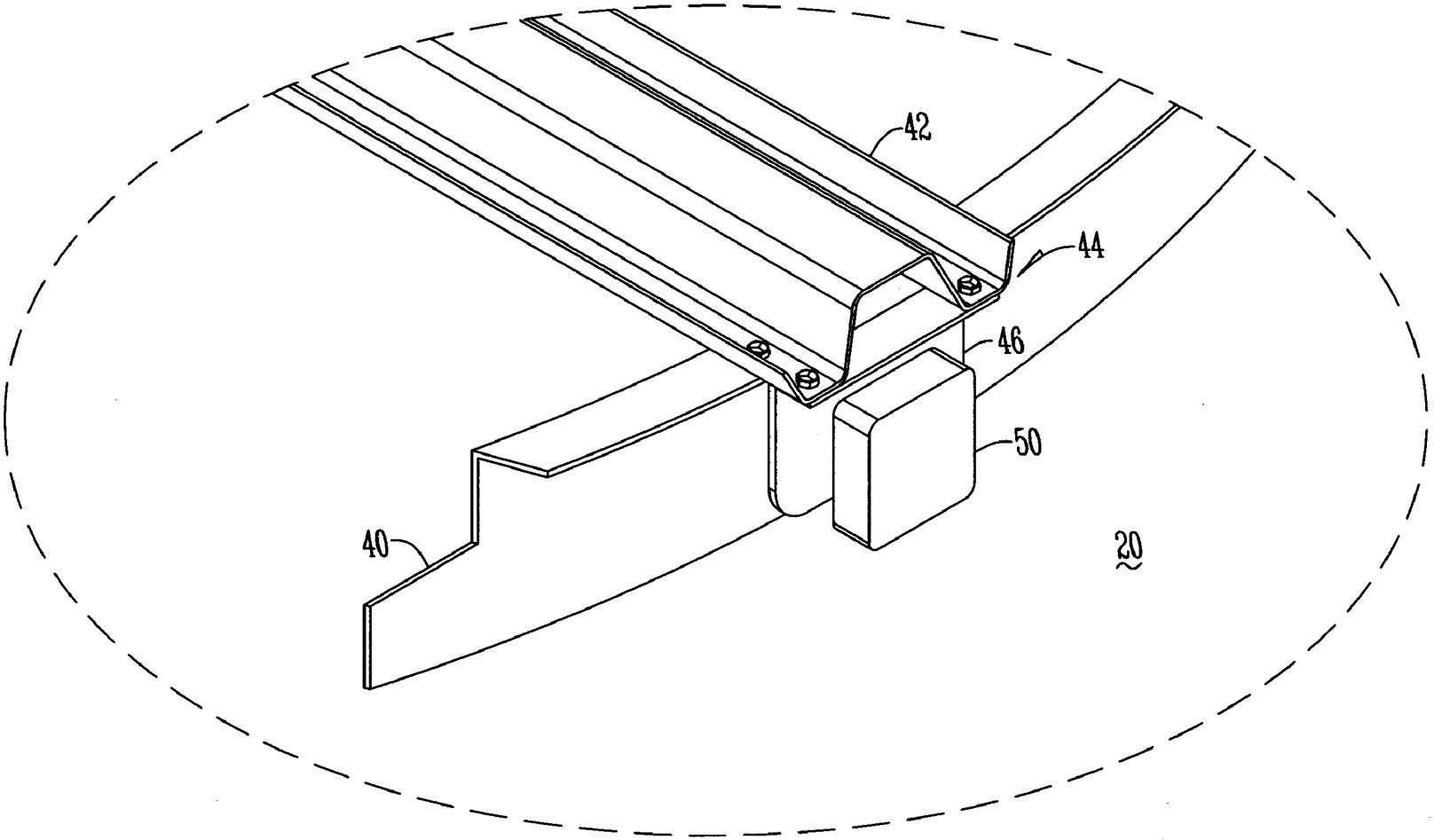
FIG. 4 is a perspective view of a portion of a rotor assembly for a grain dryer.
Figure 5:
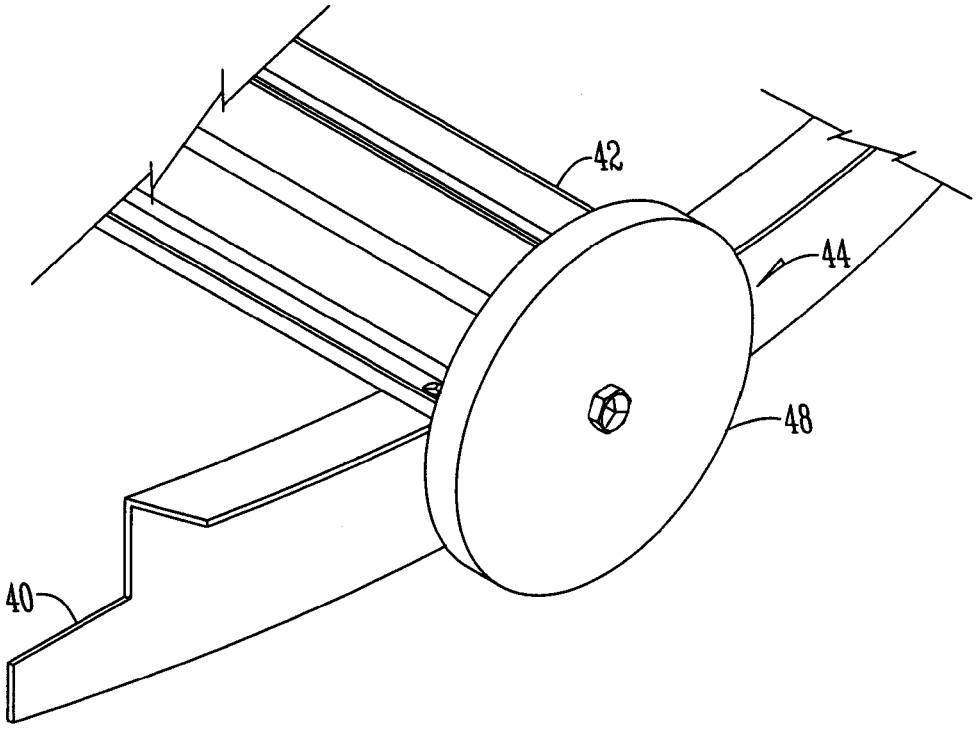
FIG. 5 is a perspective view of a portion of a rotor assembly for a grain dryer.
Figure 6:
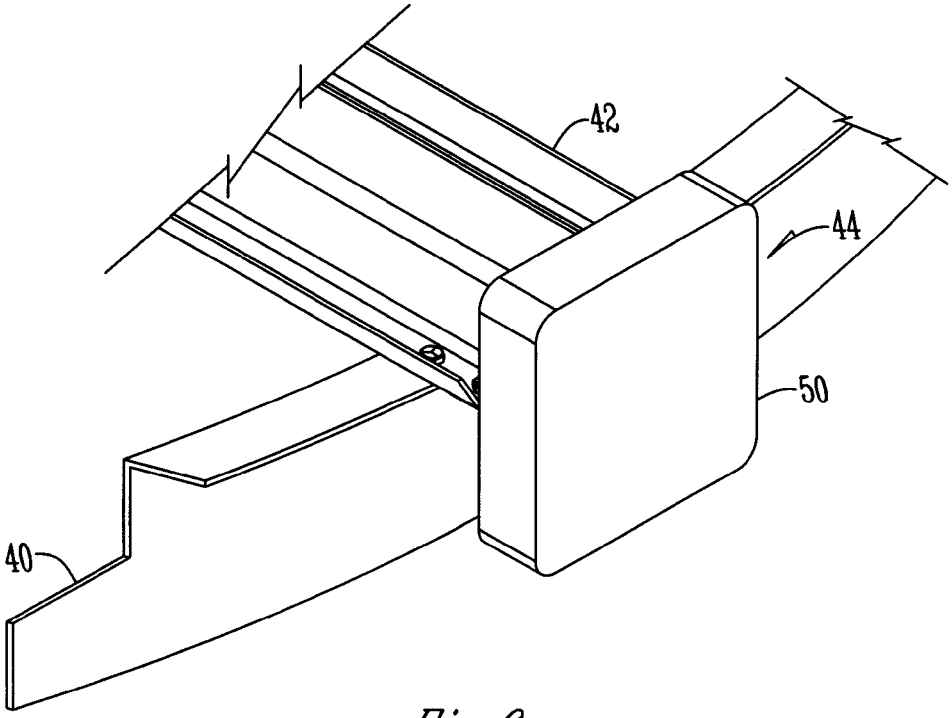
FIG. 6 is a perspective view of a portion of a rotor assembly for a grain dryer.

A grain metering system 26 is positioned in the lower portion of the grain dryer 10. In particular, the grain metering system 26 includes a rotor assembly 28 which is located within the sweep space 24. The grain metering system further includes a motor 30 which has a drive shaft 32 which is mechanically coupled to the floor sweep assembly 28. Operation of the motor 30 results in rotation of drive shaft 32 (indicated by arrow 34 in FIG. 2). The drive shaft 32 extends downwardly from the motor 30 through the hopper opening 21 and terminates in a lower end portion 36 which is supported by a support bar which is mounted within the hopper 17. The lower end portion 36 of the drive shaft 32 is located vertically below the grain shelf floor 20.

The rotor assembly 28 is rotatable around a central axis after it is installed into the grain dryer 10. In particular, the drive shaft 32 of the motor 30 is mechanically coupled to the rotor assembly 28. During the operation of the grain dryer 10, the motor 30 is driven to rotate the drive shaft 32. Rotation of the drive shaft 32 causes rotation of the rotor assembly 28 around the central axis.

The rotor assembly 28 includes a framework 38 and a number of wipers 40 secured to the framework 38. The framework may take many forms and includes a number of primary support members 42 that extend radially outwardly relative to the central axis. Connected to the end of the primary support members opposite the central axis are a number of secondary support members 44.

The secondary support members 44 can be of any form, but preferably have a plate 46 connected to the primary support member 42 that extends downwardly and a wheel 48 that is rotatably mounted to the plate 46 and positioned to engage the shelf floor 20. Alternatively, a stationary block 50 made of wood or plastic such as UHMW is connected to the plate 46 and positioned to engage the shelf floor.

The use of the secondary support member 44 facilitates the rotation of the rotor assembly 28 and by supporting the end of the primary support member 42, it assists in maintaining a uniform depth clearance between the floor and the wiper blades. The use of the wheel 48 or the block 50, also prevents the wiper blade 40 from catching a seam in the floor 20 and reduces wear on the blade and floor.

In an alternative embodiment, the wheel 48 or the block 50 are directly connected to the primary support member 42 to perform the same function. Thus, a rotor assembly has been disclosed that at the very least meets all of the stated objectives.

What is claimed is:

1. A rotor assembly for a grain dryer having a shelf floor, the assembly comprising:

a wiper secured to a framework having a primary support member that extends radially outwardly from a central axis and a secondary support member connected to the first primary support member and adapted to engage the shelf floor wherein the second support member has a plate connected to the end of the primary support member that extends downwardly and a wheel that is rotatably connected to the plate.

* * * * *